United States Patent [19]

Kamono et al.

[11] Patent Number: 4,558,917

[45] Date of Patent: Dec. 17, 1985

[54] ELECTRICAL CONNECTOR ASSEMBLY

[75] Inventors: Takashi Kamono, Yokohama; Hiromi Yamada, Yokosuka, both of Japan

[73] Assignee: AMP Incorporated, Harrisburg, Pa.

[21] Appl. No.: 652,431

[22] Filed: Sep. 20, 1984

Related U.S. Application Data

[63] Continuation of Ser. No. 520,409, Aug. 5, 1983, abandoned.

[30] Foreign Application Priority Data

Sep. 7, 1982 [GB] United Kingdom ..... 8225426

[51] Int. Cl.[4] ..... H01R 13/648

[52] U.S. Cl. ..... 339/143 R; 339/14 R; 339/176 MF

[58] Field of Search ..... 339/14 R, 14 L, 14 P, 339/143 R, 176 MF, 17 F, 49 R

[56] References Cited

U.S. PATENT DOCUMENTS

| | | | |
|---|---|---|---|
| 3,070,769 | 12/1962 | Murphy | 339/49 R |
| 3,128,138 | 4/1964 | Noschese | 339/177 R X |
| 3,482,201 | 12/1969 | Schneck | 339/14 |
| 3,691,509 | 9/1972 | Krol | 339/14 R |
| 3,745,509 | 7/1973 | Woodward et al. | 339/14 R |
| 4,027,941 | 6/1977 | Narozny | 339/14 R |
| 4,185,176 | 1/1980 | Matsuo | 200/16 D |
| 4,415,216 | 11/1983 | Narozny | 339/107 |

FOREIGN PATENT DOCUMENTS

| | | | |
|---|---|---|---|
| 0043183 | 1/1982 | European Pat. Off. | 339/14 R |

*Primary Examiner*—Eugene F. Desmond

*Attorney, Agent, or Firm*—Adrian J. LaRue; Donald M. Boles

[57] ABSTRACT

An electrical connector assembly for terminating flat shielded electrical cable comprises two matable connectors one comprising a housing carrying signal and ground contacts for connection to respective conductors of the cable, and the other comprising a housing carrying contacts for mating with the signal contacts of the one connector, the signal contacts being separated by shielding plates matable with the ground contacts of the one connector.

14 Claims, 4 Drawing Figures

ELECTRICAL CONNECTOR ASSEMBLY

This application is a continuation of application Ser. No. 520,409 filed Aug. 5, 1983, now abandoned.

FIELD OF THE INVENTION

This invention relates to an electrical connector assembly for use in terminating shielded electrical cable of the type comprising a plurality of conductors arranged in a spaced, parallel, planar array in a sheet of insulating material, certain of the conductors, in use, constituting ground conductors separating signal conductors in the array.

BACKGROUND OF THE INVENTION

Cables as set out above are used, for example, in providing connections within computers where it is necessary for the signal conductors to be shielded from each other in order to minimize difficulties caused by cross-talk.

The use of alternate conductors in a cable as ground conductors while the other interposed conductors are used as signal conductors provides effective shielding within the cable, but difficulties arise when such a cable is to be terminated by an electrical connector assembly by which the conductors of the cable are to be connected to other circuitry such as conductors on a printed circuit board.

SUMMARY OF THE INVENTION

According to this invention in an electrical assembly for use in terminating shielded electrical cable of the type comprising a plurality of conductors arranged in a spaced, parallel, planar array in a sheet of insulating material, certain of the conductors, in use, constituting ground conductors positioned between signal conductors in the array, the assembly comprising a first connector comprising a housing of insulating material carrying a plurality of contacts for connection to respective conductors of a cable, and a second connector comprising a housing of insulating material carrying a plurality of contacts matable with the contacts of the first connector when the connectors are mated, and having portions connectable to other external circuitry, contacts in the housing of the second connectors are separated by shielding plates each formed of conductive material and having a layer of insulating material on both major surfaces, the shielding plates being adapted for mating with contacts of the first connector to be connected to ground conductors of the cable, and being interconnected in the second connector by a ground bus member carried by the housing of the second connector, at least one of the shielding plates having a portion connectable to other external circuitry.

The assembly of this invention has the advantage that effective shielding is provided between adjacent contacts in the second connector while enabling all of the contacts to be used for signal conductor connections, it being unnecessary for any of the contacts to be allocated to provide a ground function.

BRIEF DESCRIPTION OF THE DRAWINGS

An electrical connector assembly according to this invention will now be described, by way of example, with reference to the drawings in which.

DETAILED DESCRIPTION OF THE INVENTION

Figure 1:
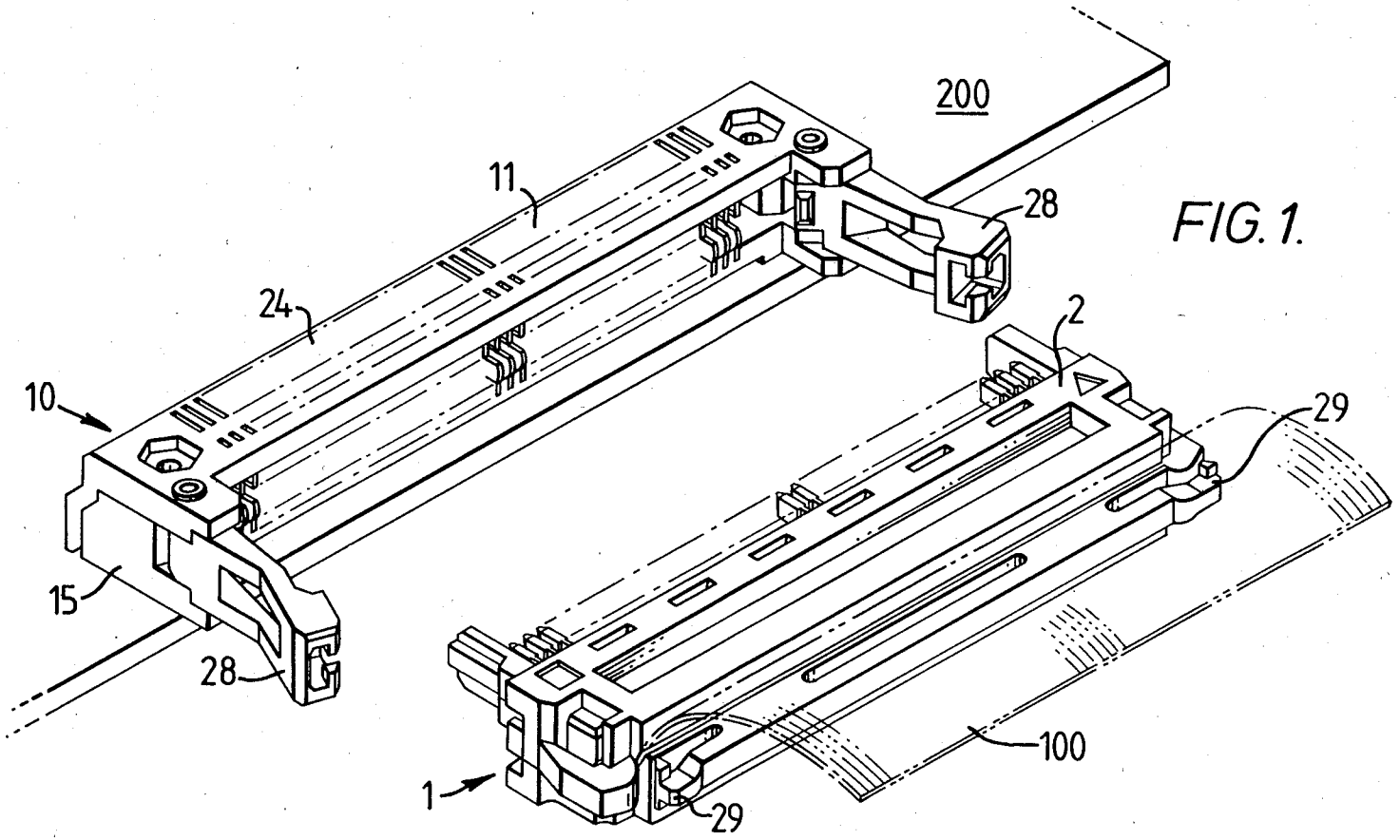
FIG. 1 is a perspective view of the assembly in the unmated condition.

The assembly shown in the drawings is for use in connecting the conductors of a flat cable 100 (FIGS. 1 and 4) to conductors (not shown) on a printed circuit board 200 (FIGS. 1 and 3), and comprises a first connector 1 having a housing 2 formed of molded insulating material parts and carrying a plurality of contacts 3 and 4 (FIGS. 3 and 4) for connection to the signal conductors 101 and ground conductors 102 of the cable 100, respectively. Each contact 3 or 4 is in the form of a strip of metal and has a conductor-connector end to which the associated conductor 101 or 102 is welded, and an opposite male contact end comprising a portion 5 or 6 turned back on itself and about a projection 7 or 8 provided by the housing 2.

The assembly also comprises a second connector 10 having a housing 11 formed of molded insulating material parts and carrying a plurality of contacts 12 stamped and formed from sheet metal. Each contact 12 comprises a pin portion 13 which projects from the housing 11 for receipt in a hole 201 (FIG. 3) in the printed circuit board 200 and connection to a conductor thereon, and a substantially U-shaped mating portion 14 which receives the contact portion 5 of an associated signal conductor contact 3 of the first connector 1, thereby electrically to connect the signal conductor 101 of the cable 100 connected to the contact 3 to the conductor (not shown) on the printed circuit board 200.

Figure 3:
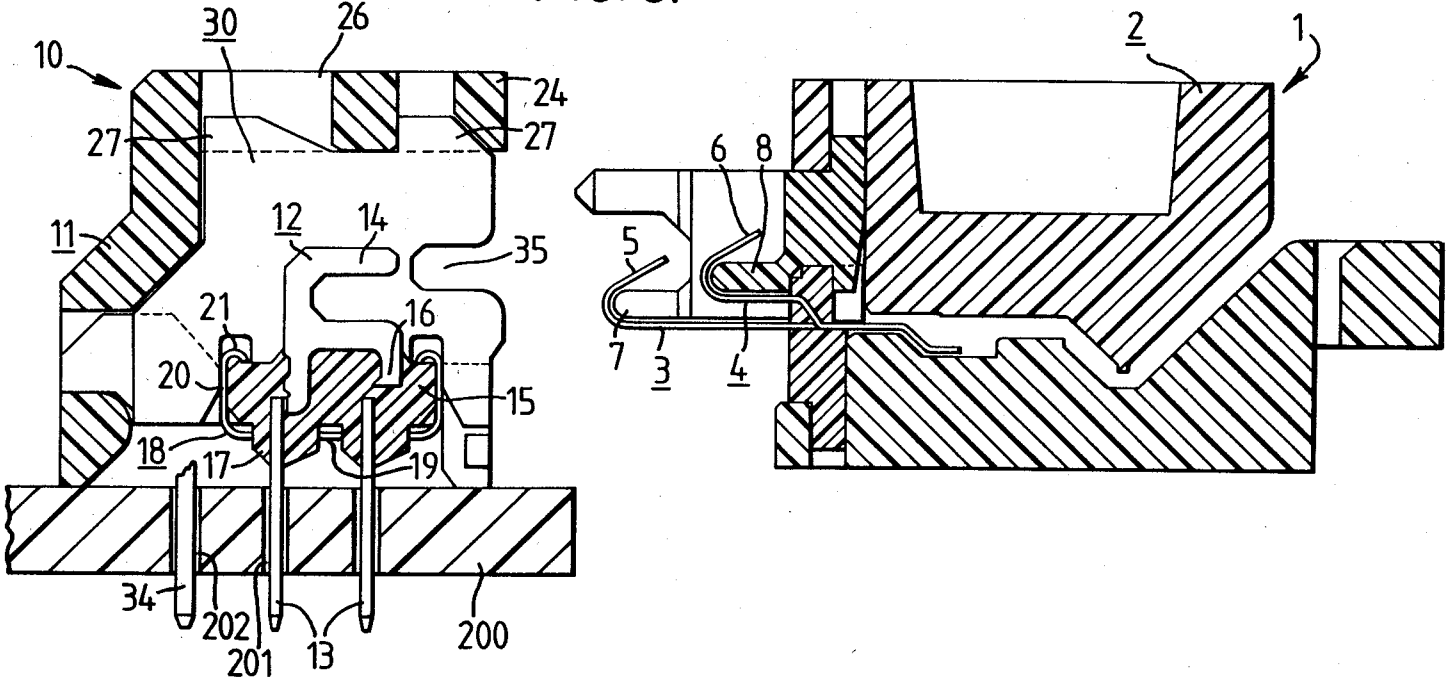
FIG. 3 is a sectional view through the first and second connectors of FIG. 1 in the unmated condition.
Figure 4:
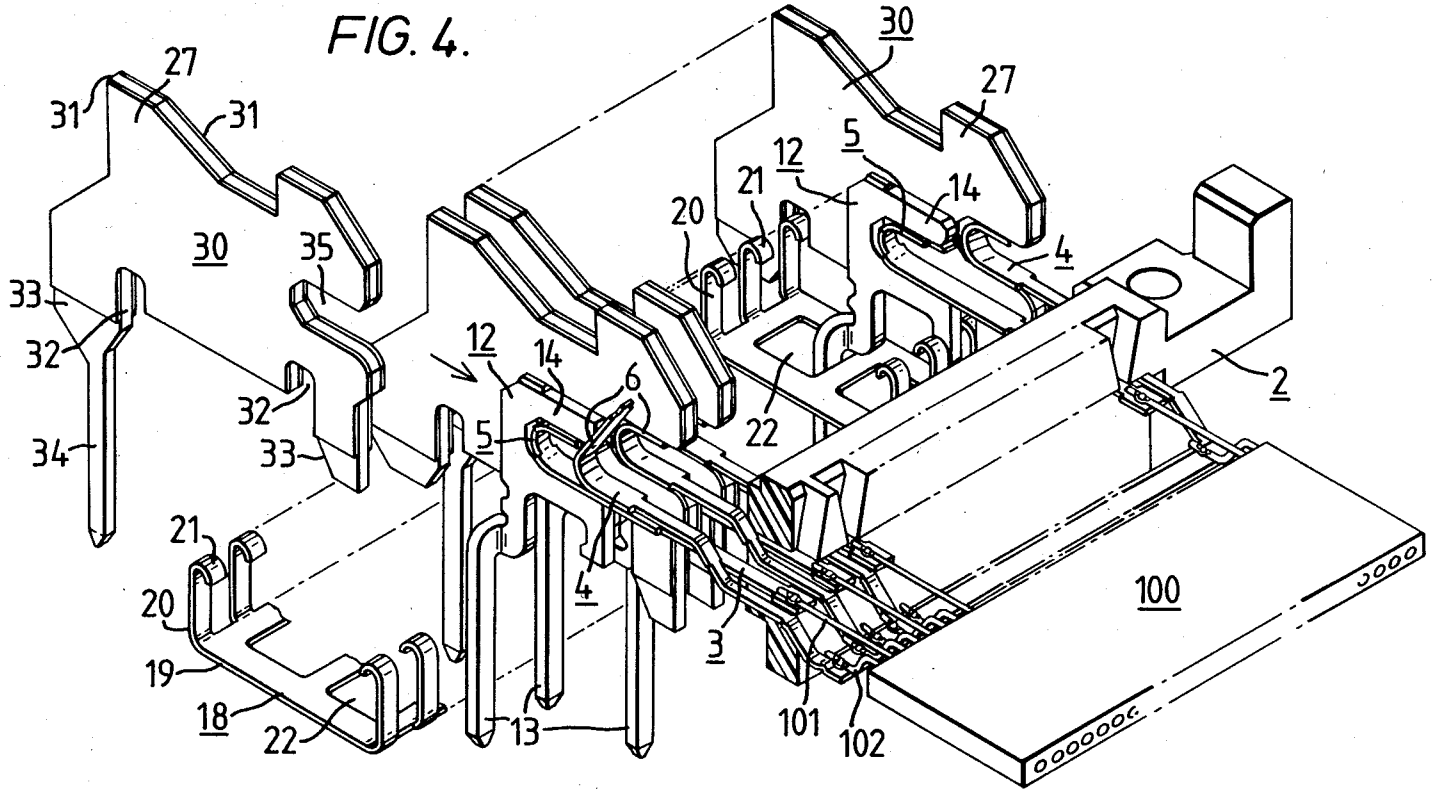
FIG. 4 is a perspective view of the contact and shielding plate arrangement of the assembly of FIG. 1.

As shown in FIGS. 3 and 4, the pin portions 13 of the contacts 12 are offset from the mating portions 14 thereof such that the pin portions 13 of the contacts 12 of pairs of adjacent contacts 12 lie in line in a plane parallel to and between the planes containing the mating portions 14 of the contacts 12 of the pair. Thus, the pin portions 13 are in pairs positioned at twice the pitch of the contacts 12 in the connector 11.

Figure 2:
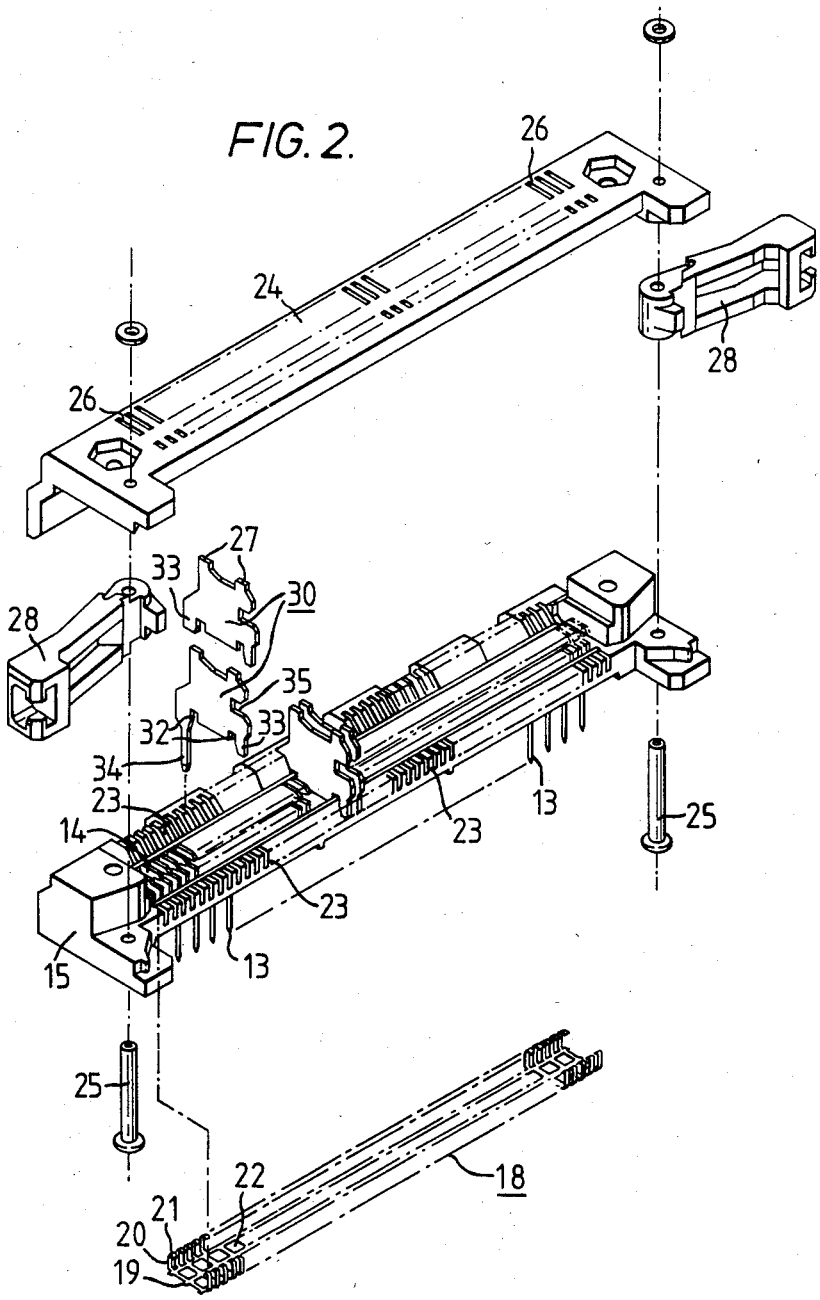
FIG. 2 is an exploded perspective view of the second connector of the assembly of FIG. 1.

The contacts 12 are carried by a part 15 (FIGS. 2 and 3) of the housing 11, which is molded about the junction between the pin portion 13 and mating portion 14 of each contact and about a projection 16 at the free end of one arm of the mating portion 14 of each contact 12, as shown in FIG. 3, an individual rectangular projection 17 being formed on the housing part 15 about each contact pin portion 13.

The second connector 10 also comprises a ground bus member 18 stamped and formed from sheet metal to have an elongate planar base 19 having a row of fingers 20 with hooked ends 21 upstanding along each longitudinal edge. The base 19 is formed with a plurality of holes 22 (FIG. 2) through which the pin portions 13 of the contacts 12 and their associated housing part projections 17 project, the pin portions 13 thus being electrically isolated from the bus member 18, when the bus member 18 is mounted on the housing part 15, the fingers 20 of the bus member 18 passing through slots 23 in the housing part 15 with the hooked ends 21 of the fingers 20 engaging about the housing part 15 thereby to secure the bus member 18 to the housing part 15. The pitch of the fingers 20 of the bus member 18 is the same as that of the contacts 12, but the fingers 20 are arranged to be between the mating portions 14 of the contacts 12.

Arranged between the mating portions 14 of the contacts 12 in the housing 11 are shielding plates 30 each stamped and formed from sheet metal and having a layer 31 of insulating material (FIG. 4) on both major surfaces. One edge of each plate 30 is formed with two slots 32 arranged to engage over the fingers 20 of the bus member 18 and hold the fingers 20 against the supporting housing part 15, as shown in FIG. 3. The conductive edges of each plate 30 are thus in electrical contact with the associated fingers 20 of the bus member 18. The edge of each plate 30 containing the slots 32 is also formed with two projecting tab portions 33 which are received in the slots 23 in the housing part 15 thereby to locate the plate 30 on the housing part 15. At least one of the plates 30 is formed with a pin portion 34 projecting from one of the tab portions 33, which pin portion 34 is received in a hole 202 in the substrate 200, as shown in FIG. 3, and serves to establish an electrical connection to a ground conductor (not shown) on the substrate 200. Thus, all of the plates 30 are electrically interconnected by the bus member 18 and are connected to the ground conductor on the substrate 200 by the one or more pin portions 34 of the plates 30. The plates 30 also provide shielding between adjacent contacts 12 in the housing 11, while the insulating layers 31 on the plates 30 prevent short circuits between adjacent contacts 12.

Another edge of each plate 30 is formed with a slot 35 which receives a ground contact 4 of the connector 1 when the connectors 1 and 10 are mated, the ground conductors 102 of the cable 100 terminated by the connector 1 thus being connected to individual shielding plates 30 in the connector 10, as shown in FIG. 4.

The plates 30 are secured to the housing part 15 by a second housing part 24 which is secured to the housing part 15 over the plates 30 by means of studs 25. The housing part 24 is formed with slots 26 which receive tab portions 27 on the plates 30, as shown in FIG. 3, whereby the plates 30 are accurately supported in spaced parallel planes between the contacts 12 as required.

The studs 25 also carry pivotal arms 28 which cooperate with projections 29 on the housing 2 thereby to latch the connectors 1 and 10 together in the mated condition.

We claim:

1. An electrical connector assembly for use in terminating shielded electrical cable of the type comprising a plurality of conductors arranged in a spaced, parallel, planar array in a sheet of insulating material, certain of the conductors, in use, constituting ground conductors positioned between signal conductors in the array, the assembly comprising a first connector comprising a housing of insulating material carrying a plurality of contacts for connection to respective conductors of a cable, and a second connector comprising a housing of insulating material carrying a plurality of contacts matable with the contacts of the first connector when the connectors are mated, and having portions connectable to other external circuitry, wherein contacts in the housing of the second connector are separated by shielding plates each formed of conductive material and having a layer of insulating material on both major surfaces, the shielding plates being adapted for mating with contacts of the first connector to be connected to ground conductors of the cable, and being interconnected in the second connector by a ground bus member carried by the housing of the second connector, at least one of the shielding plates having a portion connectable to other external circuitry.

2. A connector assembly as claimed in claim 1, wherein the portions of the contacts of the second connector and of the shielding plates connectable to other external circuitry are pin portions projecting from the housing of the second connector, the ground bus member having a planar portion formed with a plurality of holes through which the pin portions of the contacts project in electrically isolated manner.

3. A connector assembly as claimed in claim 2, wherein the pin portions of the contacts of the second connector are offset from the mating portions of the contacts such that the pin portions of the contacts of pairs of adjacent contacts lie in line in a plane parallel to and between the planes containing the mating portions of the contacts of the pair.

4. A connector assembly as claimed in claim 1, wherein the shielding plates are formed with slots which engage over supported portions of the ground bus member to establish electrical connections thereto.

5. A connector assembly as claimed in claim 1, wherein each shielding plate is formed with a slot to receive a mating contact of the first connector when the first and second connectors are mated.

6. A connector assembly as claimed in claim 1, wherein the housing of the second connector is formed of two parts secured together to define a cavity to receive a mating portion of the first connector, the shielding plates having tab portions received in grooves in the two parts of the housing thereby to secure the shielding plates in the housing in spaced parallel planes between contacts of the second connector.

7. An electrical connector, comprising:

a dielectric housing member having slots therein;

a series of electrical terminal members in said housing member spaced from each other and having contact sections;

a series of shield members having tab portions thereby securing the shield members in said housing member with each of the shield members being disposed between adjacent electrical terminal members and having contact section means;

bus means in said housing member; and means provided by the shield member and said bus means electrically connecting said bus means and the shield members together.

8. An electrical connector as set forth in claim 7, wherein the electrical terminal members are carried by a dielectric part of said housing member.

9. An electrical connector as set forth in claim 8, wherein said dielectric part has projections extending outwardly therefrom, the electrical terminal members have terminal sections extending through respective projections and exteriorly of the housing member.

10. An electrical connector as set forth in claim 9, wherein said bus means has a base containing a plurality of holes through which said projections of said dielectric part extend, said dielectric part having slots along the sides thereof, fingers of said base are disposed in respective slots and include resilient hooked ends engaging about a section of said dielectric part.

11. An electrical connector as set forth in claim 10, wherein the connecting means for connecting said bus means to shield members comprise slot means in the shield members in which the resilient hooked ends are springably disposed.

12. An electrical connector as set forth in claim 7, wherein at least one of the shield members has a terminal section extending outwardly from the housing member.

13. An electrical connector as set forth in claim 7, wherein the shield members are metal plates having a layer of insulating material on the surfaces facing respective terminal members.

14. An electrical connector as set forth in claim 7, and further comprising a matable electrical connector including another dielectric housing member in which electrical contact members are secured in the form of resilient hooked members disposed about dielectric projections provided by the another housing member so that when the electrical connectors are mated together, the resilient hooked members of the electrical contact members are electrically matable with respective contact sections of the electrical terminal members and contact section means of the shield members.

* * * * *